US006722877B2

(12) United States Patent
Wang et al.

(10) Patent No.: US 6,722,877 B2
(45) Date of Patent: Apr. 20, 2004

(54) UTILITY LIGHTER WITH DISABLING MECHANISM

(76) Inventors: Boqi Wang, Louis J. Christen & Company, Inc. 8810 Vidal Rd., SW., Albuquerque, NM (US) 87105; Lixiang Mao, Louis J. Christen & Company, Inc. 8810 Vidal Rd., SW., Albuquerque, NM (US) 87105; Dongliang Li, Louis J. Christen & Company, Inc. 8810 Vidal Rd., SW., Albuquerque, NM (US) 87105

( * ) Notice: Subject to any disclaimer, the term of this patent is extended or adjusted under 35 U.S.C. 154(b) by 234 days.

(21) Appl. No.: 09/934,316

(22) Filed: Aug. 21, 2001

(65) Prior Publication Data

US 2003/0039934 A1 Feb. 27, 2003

(51) Int. Cl.[7] ..... F23Q 2/28; F23D 11/36
(52) U.S. Cl. ..... 431/153; 431/255
(58) Field of Search ..... 431/344, 153, 431/255, 345

(56) References Cited

U.S. PATENT DOCUMENTS 4,190,034 A * 2/1980 Wonisch ..... 126/25 B
5,967,768 A 10/1999 Saito et al.
6,065,958 A 5/2000 Adams et al.
6,077,069 A 6/2000 Fairbanks et al.
6,086,358 A * 7/2000 Potskhishvili et al. ..... 431/153
6,086,359 A 7/2000 Sher
6,086,360 A 7/2000 McDonough et al.
6,093,017 A 7/2000 Saito et al.
6,095,796 A * 8/2000 Sung ..... 431/153
6,095,799 A 8/2000 McDonough et al.
6,129,544 A 10/2000 Chen
6,135,762 A 10/2000 Hu
6,135,763 A 10/2000 Man
6,200,130 B1 3/2001 Man
6,287,109 B1 * 9/2001 Hirota ..... 431/153

* cited by examiner

*Primary Examiner*—Carl D. Price
(74) *Attorney, Agent, or Firm*—Senniger, Powers, Leavitt & Roedel

(57) ABSTRACT

A utility lighter having a housing and a spark generator operable to generate a spark generally adjacent an exit opening of the housing. Movement of a trigger from its inoperative position to its operative position in a normal mode of operation of the lighter operates the spark generator to generate a spark. A disabling mechanism is positionable relative to the housing between a first position corresponding to a disabled mode of operation of the lighter in which the lighter is ineffective to generate a spark and a second position corresponding to the normal mode of operation of the lighter. The trigger is movable between its inoperative and operative positions in both the disabled mode and the normal mode of the lighter. In the disabled mode of the lighter the disabling mechanism is adapted to disable the trigger from operating the spark generator in the operative position of the trigger.

21 Claims, 5 Drawing Sheets

UTILITY LIGHTER WITH DISABLING MECHANISM

BACKGROUND OF THE INVENTION

This invention relates generally to a utility lighter and more particularly to a utility lighter having a disabling mechanism that inhibits undesired igniting of the lighter, such as by small children.

Conventional utility lighters typically have a handle, an elongate barrel extending from the handle, a fuel container in the handle containing combustible fuel, a piezoelectric unit for generating a spark to ignite the combustible fuel and a trigger for controlling operation of the lighter to generate a flame that is exhausted from an open end of the barrel away from the handle. These lighters have become increasingly popular for home use, such as in lighting fires, grills, candles, stoves and other items due to the ease of use of the lighter and the fact that the elongate barrel extending outward from the handle allows the operator to direct the flame into hard to reach areas and to remain at a relatively safe distance from the flame generated by the lighter and from the item at which the flame is directed. However, safety concerns have arisen as utility lighters have become more accessible to small children who are unfamiliar with the dangers associated with the misuse of such lighters.

As a result, various devices have recently been incorporated into utility lighters to resist undesired igniting of the lighters by small children. For example, one common type of device blocks the trigger against operative movement until the device has been sufficiently manipulated to remove the structure blocking the trigger against movement, thereby allowing a normal lighting operation to occur.

U.S. Pat. No. 6,135,763 discloses another type of utility lighter having a device in which the trigger is movable through its full range of motion even when the lighter is prevented from generating a flame. Allowing full movement of the trigger without generating a flame more realistically simulates normal operation of the lighter so that a younger child is likely to assume the lighter is simply broken and no longer wants to play with the lighter. In normal operation, depressing the trigger activates a fuel-release lever to open a valve for releasing fuel from the fuel container and also depresses the piezoelectric unit to generate a spark for igniting the fuel. To prevent a flame from being generated, the device positions the trigger and the release lever out of operative alignment with each other so that fuel cannot be released from the fuel container even when the trigger is depressed.

However, such a utility lighter still has a number of drawbacks. For example, when the trigger is depressed, the piezoelectric unit is still operated by the trigger to generate a spark even though no fuel is released from the fuel container. There is a risk that such a spark could ignite combustible fuel or other flammables from an external source, such as a gas can or a gas operated grill, stove, fireplace or other gas operated device. Also, the piezoelectric unit is generally limited in the number of electrical charges that it can generate. Thus, each depression of the trigger decreases the useful lifetime of the piezoelectric unit, i.e., the remaining number of electrical charges that can be generated by the unit, even if a flame is not ignited. Such a disadvantage is of concern for utility lighters of the re-usable type wherein the fuel container may be refilled with additional fuel to continue use of the lighter.

SUMMARY OF THE INVENTION

Among the several objects and features of the present invention may be noted the provision of a utility lighter which inhibits undesired igniting of the lighter, such as by small children; the provision of such a utility lighter which inhibits undesired igniting of flammable materials external of the lighter; the provision of such a utility lighter which can increase the life of a spark generator of the lighter; and the provision of such a utility lighter which is easy to use.

In general, a utility lighter of the present invention comprises a housing and a spark generator operable to generate a spark generally adjacent an exit opening of the housing. A trigger is movable relative to the housing between an inoperative position and an operative position. Movement of the trigger to its operative position in a normal mode of operation of the lighter operates the spark generator to generate a spark. A disabling mechanism is positionable in a first position corresponding to a disabled mode of operation of the lighter and a second position corresponding to the normal mode of operation of the lighter. The trigger is movable between its inoperative and operative positions in both the disabled mode and the normal mode of the lighter. In the disabled mode of the lighter the disabling mechanism is adapted to disable the trigger from operating the spark generator in the operative position of the trigger.

In another embodiment, a utility lighter of the present invention generally comprises a housing and a fuel container generally disposed in the housing for containing a combustible fuel. A sealing valve is in fluid communication with the fuel container and movable between a closed, sealing position in which the fuel container is sealed against fuel release and an open position in which fuel is released from the fuel container for delivery toward the exit opening of the housing. A valve lever is movable relative to the housing and is operatively connected to the sealing valve whereby movement of the lever effects movement of the sealing valve between its closed and open positions. A spark generator is operable to generate a spark generally adjacent an exit opening of the housing and has an actuating mechanism movable relative to the housing to a discharge position in which the spark generator generates a spark. A trigger is movable relative to the housing between an inoperative position and an operative position, movement of the trigger to its operative position in a normal mode of operation of the lighter effecting movement of the valve lever to move the sealing valve to its open position and operating the spark generator to generate a spark to thereby ignite the fuel to generate a flame at the exit opening of the housing. A disabling mechanism is positionable in a first position corresponding to a disabled mode of operation of the lighter and a second position corresponding to the normal mode of operation of the lighter. The trigger is movable between its inoperative and operative positions in both the disabled mode and the normal mode of the lighter. In the disabled mode of the lighter, the disabling mechanism is adapted to disable the trigger from operating the spark generator in the operative position of the trigger.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
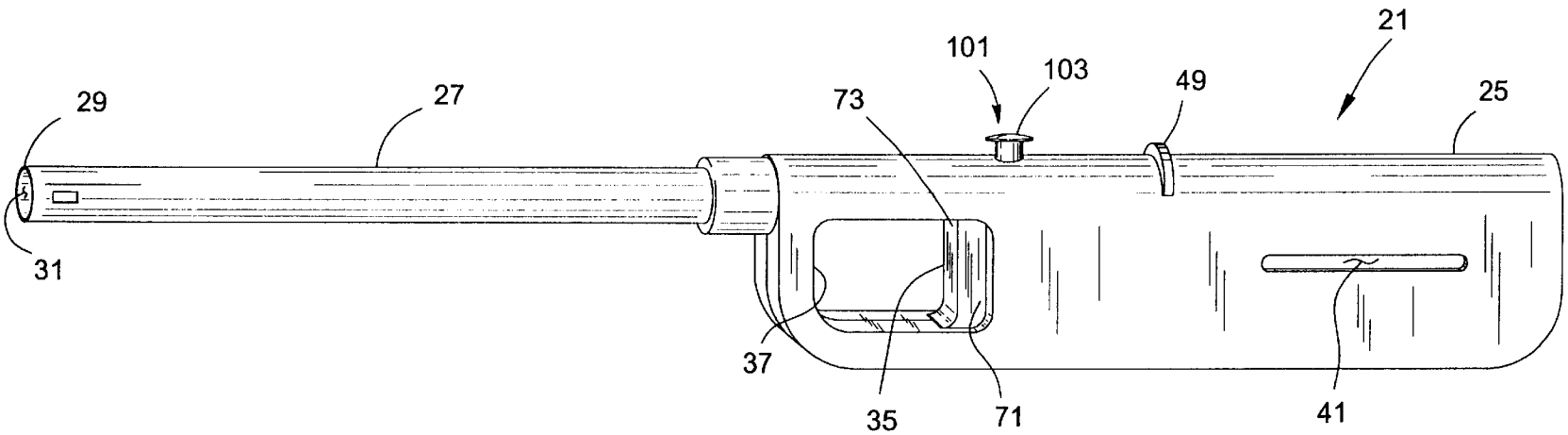
FIG. 1 is a perspective view of a utility lighter of the present invention having a disabling mechanism.

Referring now to the drawings and in particular to FIG. 1 a utility lighter of the present invention is generally designated in its entirety by the reference numeral 21. The lighter 21 comprises a handle 25 and an elongate barrel 27 secured to the handle and extending forward therefrom (the handle and barrel together broadly defining a housing of the lighter in the illustrated embodiment). A front end 29 of the barrel 27 is open to define an exit opening of the lighter 21. The handle 25 of the illustrated embodiment is of two-piece construction, divided generally along a vertical plane extending the length of the handle, and in its assembled state defines an interior 33 (FIG. 2) for housing various operating components of the lighter 21 as discussed further herein. A trigger 35 is accessible within a finger opening 37 of the handle 25 to permit digital manipulation of the trigger between an extended, inoperative position and a depressed, operative position in which, in a normal mode of operation of the lighter, a flame is generated generally at the exit opening of the lighter 21 defined by the open front end 29 of the barrel 27 (see FIG. 1).

Figure 2:
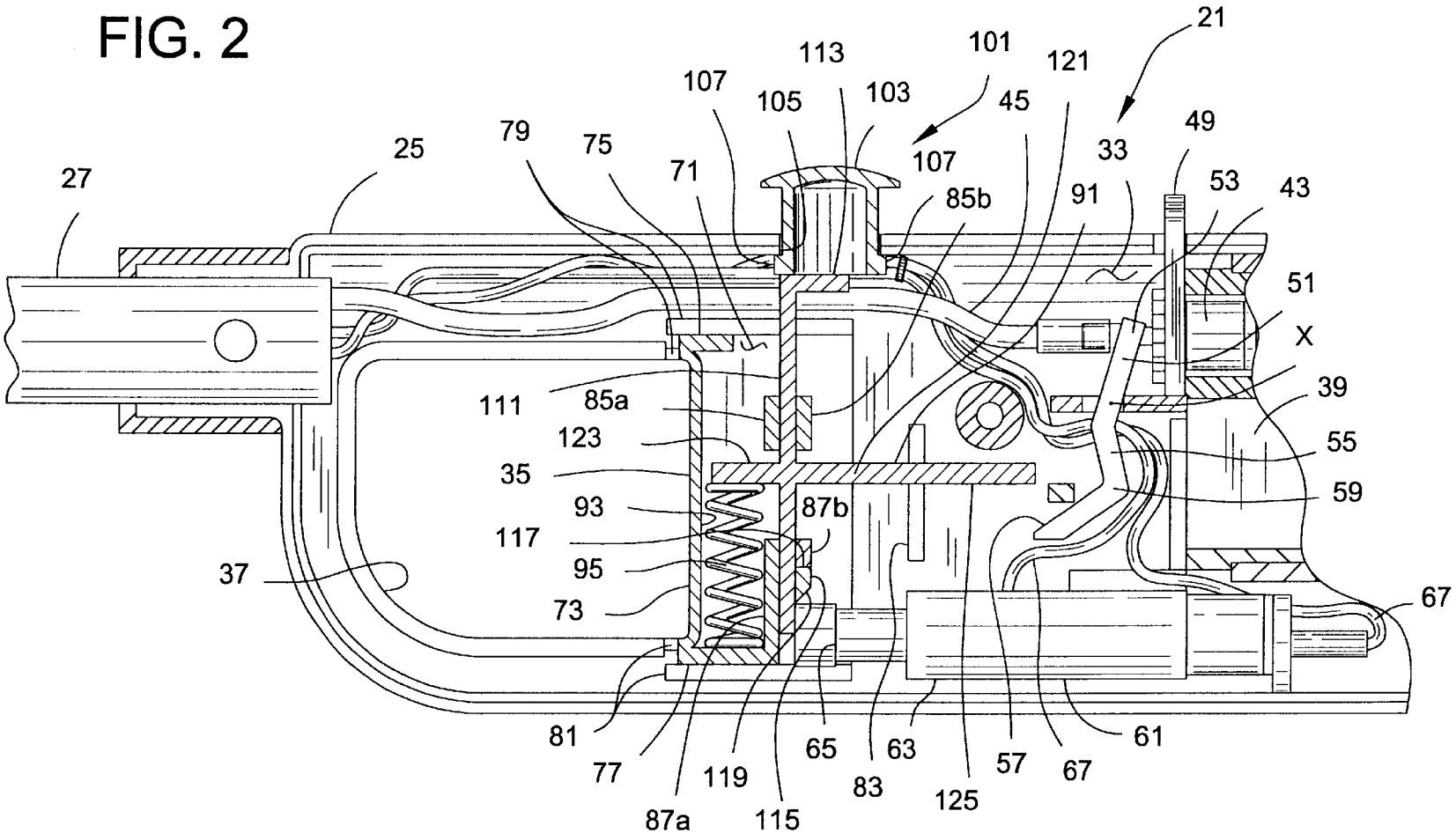
FIG. 2 is a fragmentary vertical section of the utility lighter of FIG. 1 with the lighter in a disabled mode and the trigger in an extended position.

A transparent fuel container 39 (a portion of which is shown in FIG. 2) is disposed in the interior 33 of the handle 25 generally toward the rear of the handle for containing a combustible fuel, such as butane. As shown in FIG. 1, a slot 41 extends generally longitudinally within the handle 25 to provide a window for monitoring the volume of fuel in the transparent fuel container 39. A sealing valve 43 (FIG. 2) is positioned in the interior 33 of the handle 25 in fluid communication with the fuel container 39 for sealingly closing the fuel container in a closed position of the valve to seal the fuel container against the release of fuel. The sealing valve 43 can be moved relative to the fuel container 39 between its closed position and an open position in which fuel is released from the fuel container through the valve for delivery toward the open end 29 of the barrel 27 via a fuel line 45 connected to the sealing valve in fluid communication therewith and extending forward through the handle 25 and barrel. The sealing valve 43 is biased toward its closed position by a spring element (not shown) disposed in the valve. The sealing valve 43 also includes a conventional flame-adjustment control 49 accessible exterior of the handle 25 for manually adjusting the amount of fuel released from the fuel container 39 in the open position of the valve to control the length of the flame generated by the lighter 21.

A valve lever 51 is pivotally mounted in the handle 25 for pivoting movement relative thereto about a laterally extending pivot axis X of the valve lever. An upper segment 53 of the valve lever 51 extends upward relative to the pivot axis X and is connected to the sealing valve 43. Such a connection mechanically allows pivoting movement of the valve lever 51 about the pivot axis X to effect translational positioning of the sealing valve 43 from its closed position (FIG. 4) to its open position (FIG. 5) against the bias of the spring element disposed in the valve. A lower segment 55 of the valve lever 51 extends downward relative to the pivot axis X and has a generally V-shaped configuration. A lower end 57 of the valve lever 51 is disposed substantially forward of the apex, or rearwardmost extent 59 of the V-shaped lower segment 55 of the lever (i.e., the portion closer to the trigger mechanism) in the closed position of the sealing valve 43.

Still referring to FIG. 2, a piezoelectric unit 61 (broadly, a spark generator) operable to generate a spark for igniting the fuel is mounted in the handle 25 generally below the lower end 57 of the valve lever 51 and extends longitudinally therein rearward of the trigger 35. The piezoelectric unit 61 comprises a piezoelectric crystal (not shown) enclosed in a block 63, and a plunger 65 (broadly, an actuating mechanism) telescopically received in the block 63 and extending forward from the block toward the trigger 35. The plunger 65 is capable of telescoping movement relative to the block 63 between an extended, inoperative position and a depressed, discharge position in which the piezoelectric unit 61 generates an electrical discharge. Suitable electrical wires 67 are electrically connected to the piezoelectric unit 61 and extend forward within the handle 25 and into the barrel 27 to locate a spark toward the front end 29 of the barrel for igniting combustible fuel delivered to the barrel from the fuel container 39 to generate a flame. The plunger 65 of the piezoelectric unit 61 is biased toward its extended position by a spring element (not shown) housed in the block 63. The piezoelectric unit 63 is conventional and well known in the art and, therefore, further construction and operation of the unit will not be described herein except to the extent necessary to describe the present invention.

The trigger 35 of the illustrated embodiment is generally rectangular, having side panels 71 (one of which may be seen in FIG. 1 and the other of which may be seen in FIG. 2), a front panel 73 accessible exterior of the handle 25 within the finger opening 37, a top panel 75 and a bottom panel 77. As shown in FIG. 2, the bottom panel 77 extends rearward from the bottom of the front panel 73 to about one-half the length of the side panels 71. Runners (not shown) extend laterally outward from the top and bottom of each of the side panels 71 and seat within upper and lower sets of longitudinally extending guide rails 79, 81 formed integrally with the inner surface of the handle 25 to secure the trigger 35 against movement relative to the handle other than translational movement between its extended, inoperative position and its depressed, operative position. A stop limit 83 is formed integrally with the handle 25 and extends inward of the interior 33 of the handle generally to limit the longitudinally rearward travel of the trigger 35. Thus, in the illustrated embodiment the trigger 35 engages the stop limit 83 in the depressed, operative position of the trigger. However, it is understood that the operative position of the trigger 35 may be defined other than by a stop limit 83, such as by the position at which the front panel 73 of the trigger is flush with the handle 25 in the finger opening 37 or by other suitable structure without departing from the scope of this invention.

Upper positioning members 85*a*, 85*b* extend laterally between the side panels 71 of the trigger 35 in generally parallel, spaced relationship with each other. The upper positioning members 85*a*, 85*b* of the illustrated embodiment are the same height as each other. Lower positioning members 87*a*, 87*b* extend laterally between the side panels 71 in generally parallel, spaced relationship with each other, with the spacing therebetween being substantially the same as the spacing between the upper positioning members 85*a*, 85*b* so that the lower positioning members are generally vertically aligned with the upper positioning members. The forward lower positioning member 87*a* is formed integrally with the bottom panel 77 of the trigger 35 and extends upward between the side panels 71 to define, along with the front panel 73, side panels and bottom panel of the trigger, a seat 93 for locating and holding a spring 95 (broadly, a biasing member) in a generally vertical orientation within the trigger.

A disabling mechanism of the utility lighter 21 of the present invention is generally indicated at 101 and comprises an actuator 91, the spring 95 seated in the trigger 35 and a button 103 broadly defining a control for the mechanism. The button 103 is positioned in an opening 105 in the top of the handle 25 and extends outward of the handle for accessibility in manually positioning the disabling mechanism 101 between a first, raised position (FIG. 2) corresponding to a disabled mode of the utility lighter 21 and a second, lowered position (FIG. 4) corresponding to a normal mode of the utility lighter. The lower end of the button 103 has nubs 107 extending radially outward therefrom for engaging the handle 25 within the interior 33 of the handle to retain the button in the handle. The top of the button 103 is flanged to inhibit the button against being depressed fully into the interior of the handle 25. It is understood that a control other than a button 103, such as a switch, a toggle, a slide, a lever or other suitable control may be used to position the disabling mechanism 101 between its first position corresponding to the disabled mode of the lighter 21 and its second position corresponding to the normal mode of the lighter without departing from the scope of this invention.

Figure 3:
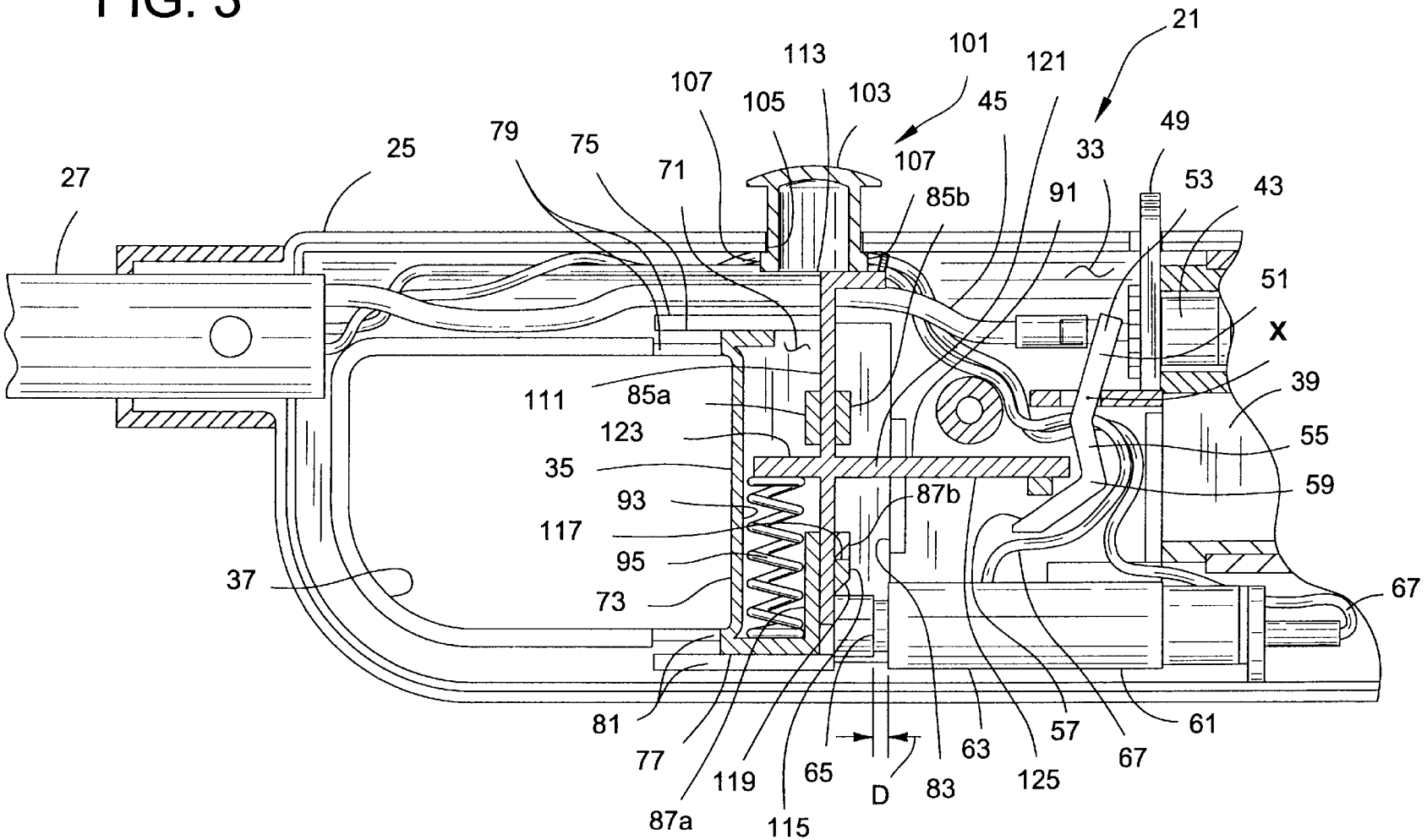
FIG. 3 is the vertical section of FIG. 2 with the lighter in the disabled mode and the trigger in a depressed position.

Still referring to FIG. 2, the actuator 91 has a support member 111 extending vertically within the interior 33 of the handle 25 generally from the lower end of the button 103 down between the side panels 71 of the trigger 35 to between the front end of the plunger 65 of the piezoelectric unit 61 and the forward lower positioning member 87*a* of the trigger. The support member 111 is sized for seating between the upper positioning members 85*a*, 85*b* and the lower positioning members 87*a*, 87*b* of the trigger 35 in generally close fitting relationship therewith to connect the actuator 91 and trigger for conjoint translational movement between the extended and depressed positions of the trigger. However, as shown in FIGS. 2 and 3, the support member 111 is slidable vertically in the positioning members 85*a*, 85*b*, 87*a*, 87*b* relative to the trigger 35 (e.g., in a direction normal to the direction of travel of the trigger) between the first, raised position and the second, lowered position of the disabling mechanism 101. A flange 113 extends longitudinally rearward from the top of the support member 111 of the actuator 91 and provides a bearing surface engageable by the bottom of the button 103 to operatively connect the button and the actuator. The flange 113 is sized such that the bottom of the button 103 remains in engagement therewith throughout the full longitudinal travel of the actuator 91 as the trigger 35 is moved between its extended and depressed positions.

A finger 115 extends rearward from the support member 111 in spaced relationship above the lower end of the support member such that in the first, raised position of the disabling mechanism 101 corresponding to the disabled mode of the lighter 21 the front end of the plunger 65 of the piezoelectric unit 61 engages the support member below the finger. In this manner the plunger 65 and the trigger 35 are operatively connected via the lower end of the support member 111 below the finger 115 in the first, raised position of the disabling mechanism 101. However, it is understood that the lower end of the support member 111 extending down below the finger 115 may be omitted, such that the plunger 65 and the trigger 35 are operatively connected via direct engagement with each other below the insert, without departing from the scope of this invention. The top of the finger 115 defines a shoulder 117 for engaging the rear lower positioning member 87*b* to limit upward movement of the actuator 91 under the bias of the spring 95. The bottom of the finger 115 is tapered to define a contact surface 119 that facilitates interposition of the insert between the front end of the plunger 65 and the forward lower positioning member 87*a* of the trigger 35 upon downward movement of the actuator 91 to the second, lowered position of the disabling mechanism 101 corresponding to the normal mode of the lighter 21.

The actuator 91 further comprises a horizontally extending actuating member 121 crossed with the support member 111 generally centrally of the support member intermediate the upper and lower positioning members 85*a*, 85*b*, 87*a*, 87*b* of the trigger 35. A forward extent 123 of the actuating member 121 extends forward from the support member 111 generally over the spring seat 93 defined by the forward lower positioning member 87*a*, the front panel 73, the side panels 71 and the bottom panel 77 of the trigger 35 such that the spring 95 engages the underside of the forward extent of the actuating member. The spring 95 is preferably maintained in compression by the actuating member 121 to continually bias the actuator 91, and hence in the illustrated embodiment the entire disabling mechanism 101, upward towards the first, raised position of the mechanism corresponding to the disabled mode of the lighter 21. A rearward extent 125 of the actuating member 121 extends rearward from the support member 111 beyond the stop limit 83 to generally adjacent the lower segment 55 of the valve lever 51.

With reference to FIGS. 2 and 3, operation of the utility lighter 21 in its disabled mode will be now be described. In the disabled mode of the lighter 21, the disabling mechanism 101 is in its first, raised position, with the button 103 extending outward of the handle 25. The rearward extent 125 of the actuating member 121 of the actuator 91 is generally vertically aligned with the apex 59 of the V-shaped lower segment 55 of the valve lever 51. The lower end of the support member 111 of the actuator 91 below the finger 115 is positioned between the front end of the plunger 65 and the forward lower positioning member 87*a* of the trigger 35 such that the trigger and the plunger are operatively connected. The bias of the spring 95 of the disabling mechanism 101 urges the forward extent 123 of the actuating member 121 of the actuator 91 upward relative to the handle 25 such that the shoulder 117 defined by the top of the finger 115 seats against the rear lower positioning member 87*b* of the trigger 35, with the finger out of alignment with the plunger 65 of the piezoelectric unit 61.

FIG. 2 shows the utility lighter 21 in its disabled mode with the trigger 35 in its extended, inoperative position. When the trigger 35 is squeezed rearward toward its depressed, operative position (FIG. 3) in the disabled mode of the utility lighter 21, the actuator 91 moves conjointly rearward with the trigger and depresses the plunger 65 of the piezoelectric unit 61 inward relative to the block 63 toward the depressed, discharge position of the plunger. The stop limit 83 stops the rearward travel of the trigger 35 in the depressed, operative position of the trigger. In this position, the plunger 65 of the piezoelectric unit 61 is not depressed into the block 63 a distance sufficient to generate an electrical discharge, i.e., the plunger does not reach its depressed, discharge position. As shown in FIG. 3, the front end of the plunger 61 is still spaced from the block 63 a distance D in the depressed, operative position of the trigger 35. As a result, an electrical discharge cannot be generated by the piezoelectric unit 61 in the disabled mode of the lighter 21. Also, as the actuator 91 is moved rearward by the trigger 35, the V-shaped configuration of the lower segment 55 of the valve lever 51 allows the actuator 91 to move through the full longitudinal travel of the trigger 35 without the rearward extent 125 of the actuating member 121 engaging the valve lever 51. As a result, movement of the trigger 35 to its depressed, operative position is ineffective to position the sealing valve 43 in its open position in the disabled mode of the lighter 21.

Figure 4:
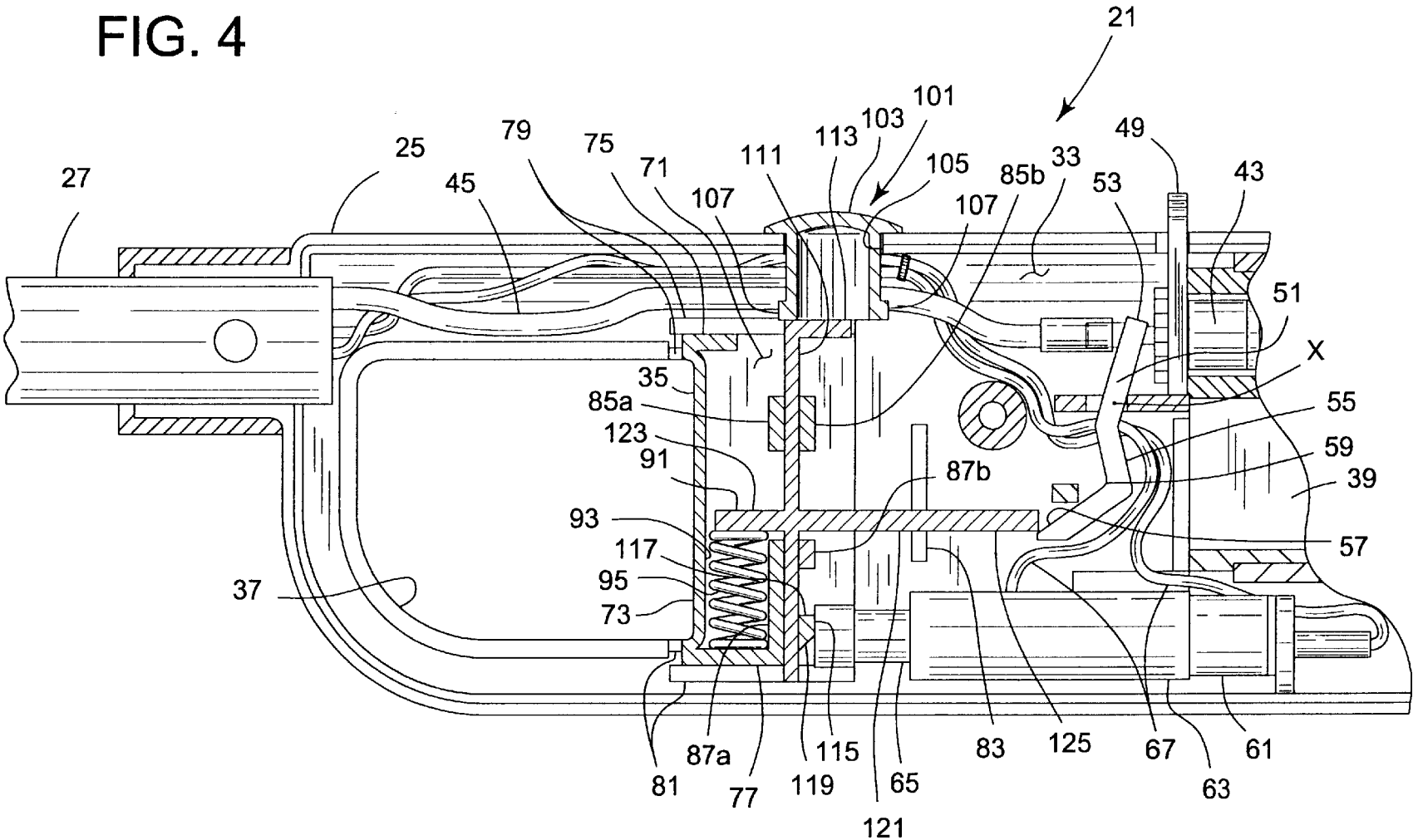
FIG. 4 is the vertical section of FIG. 2 with the lighter in a normal mode and the trigger in its extended position.
Figure 5:
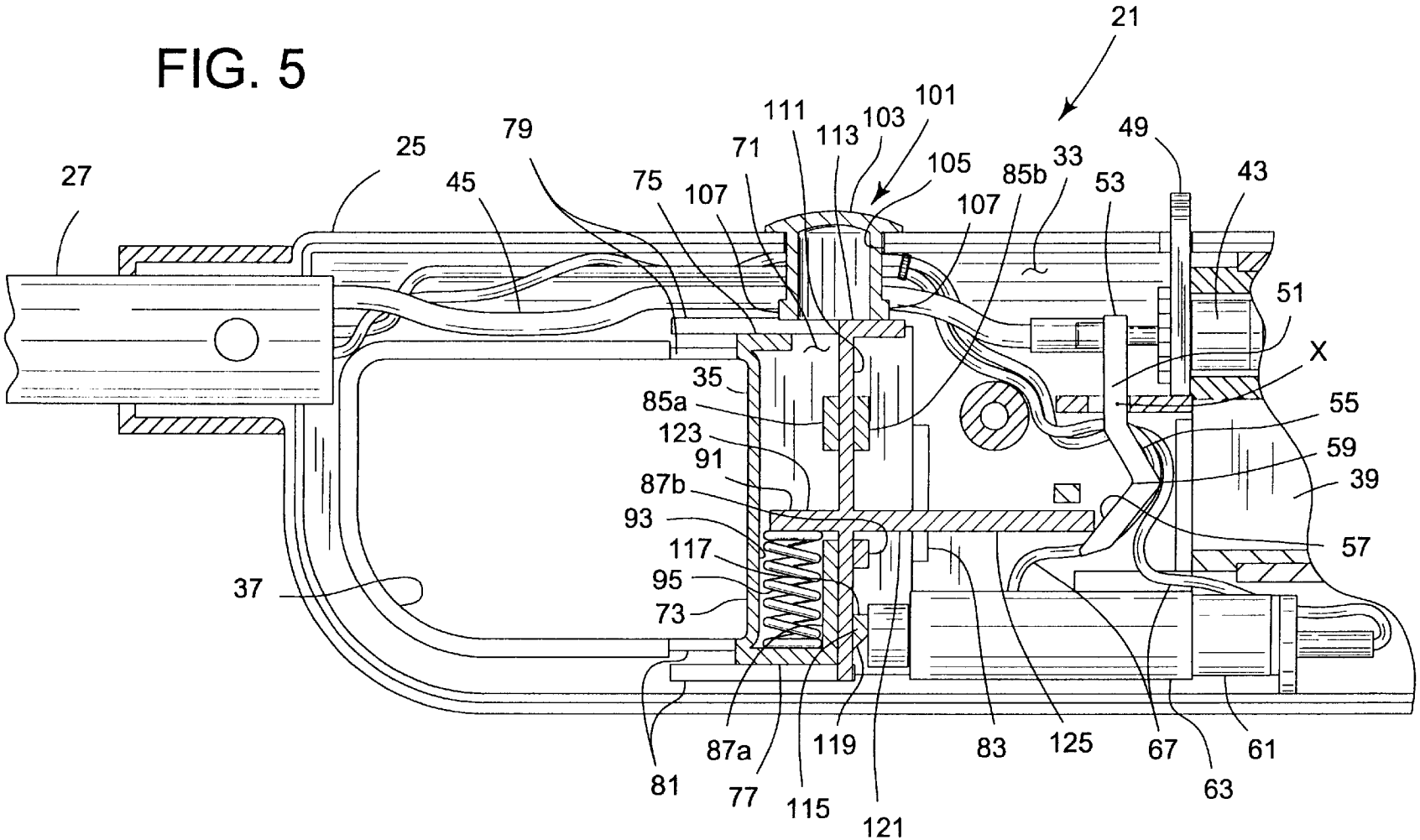
FIG. 5 is the vertical section of FIG. 2 with the lighter in the normal mode and the trigger in its depressed position.

Operation of the utility lighter 21 in its normal mode to generate a flame will now be described with respect to FIGS. 4 and 5. While gripping the handle 25 of the lighter 21 with one hand, the index finger of the hand is placed over the front panel 73 of the trigger 35 within the finger opening 37 of the handle and another finger, such as the thumb, is used to depress the button 103 of the disabling mechanism 101 to position the mechanism in its second, lowered position corresponding to the normal mode of the lighter 21 (FIG. 4). Depressing the button 103 urges the actuator 91 downward relative to the trigger 35 against the bias of the spring 95. The taper of the contact surface 119 of the finger 115 allows the finger to wedge itself between the front end of the plunger 65 and the forward lower positioning member 87*a* of the trigger 35. As the wider portion of the tapered contact surface 119 is interposed therebetween, the finger urges the trigger 35 to slide forward relative to the handle 25 a small distance in the extended, inoperative position of the trigger. The rearward extent 125 of the actuating member 121 of the actuator 91 is positioned in generally vertical alignment with the lower end 57 of the valve lever 51 in longitudinal closely spaced relationship therewith.

To ignite a flame, the trigger 35 is squeezed toward its depressed, operative position (FIG. 5) in the normal mode of the utility lighter 21. The actuator 91 moves conjointly rearward with the trigger 35 such that the actuating component 121 of the actuator 91 engages the lower end 57 of the valve lever 51 and urges the valve lever to pivot about the pivot axis X in a clockwise direction. As a result, the valve lever 51 moves the sealing valve 43 against the bias of the spring element disposed in the valve to its open position whereby fuel is released from the fuel container 39 for delivery through the fuel line 45 toward the front end 29 of the barrel 27. Rearward movement of the trigger 35 also depresses the plunger 65 of the piezoelectric unit 61 inward of the block 63. The finger 115 interposed between the plunger 65 and the forward lower positioning member 87*a* of the trigger 35 allows the plunger to be sufficiently depressed relative to the block to its fully depressed, discharge position in the depressed, operative position of the trigger. The piezoelectric unit 61 thus generates an electrical discharge that is conducted through the electrical circuit completed by the electrical wires 67 to generate a spark toward the front end 29 of the barrel 27. The spark ignites the combustible fuel to generate a flame generally at the exit opening of the lighter 21.

The button 103 must be manually held in its depressed position throughout operation of the lighter in its normal mode. Otherwise, the spring 95 of the disabling mechanism would urge the actuator 91 upward relative to the trigger 35 to the first, raised position of the mechanism. The actuating component 121 of the actuator 91 would thus move out of alignment with the lower end 57 of the valve lever 51 and the spring in the valve 43 to move to its closed position, thereby cutting off fuel delivery to the barrel to sustain the flame.

Once the trigger 35 is released, the bias of the spring in the piezoelectric unit 61 urges the trigger 35 forward to its extended, inoperative position. The spring element disposed in the sealing valve 43 urges the sealing valve to move to its closed, sealing position, with the valve lever 51 being correspondingly pivoted about the pivot axis X, to inhibit fuel against release from the fuel container so that the flame is extinguished. To return the utility lighter 21 to its disabled mode, the button is released and the spring 95 of the disabling mechanism urges the actuator 91 upward relative to the trigger 35 to the first, raised position of the mechanism, thereby pushing the button 103 upward to project outward from the handle 25.

The utility lighter 21 as shown and described herein is of the type whereby a combustible fuel and an electrical discharge are concurrently delivered toward an exit opening of the lighter such that the electrical discharge ignites the fuel to generate a flame. However, it is understood that lighters lacking a fuel container whereby only an electrical discharge is delivered toward an exit opening of the lighter for use in igniting fuel from an external fuel source, such as a gas grill, fireplace, stove or similar gas operated device, may incorporate the disabling mechanism 101 of the present invention. In the disabled mode of such a lighter, the disabling mechanism 101 would still inhibit an electrical discharge against being generated as the trigger 35 is moved to its depressed, operative position to prevent igniting fuel from the external fuel source.

Other configurations of the utility lighter 21 are also considered to be within the scope of the present invention. For example, instead of the piezoelectric unit 61 biasing the trigger 35 toward its extended, inoperative position, the trigger may be biased toward its extended, inoperative position by other means, such as a spring element (not shown) disposed in the handle 25. Moreover, the plunger 65 of the piezoelectric unit 61 may be spaced from (e.g., free from engagement with) the trigger 35 or the actuator 121 in the extended, inoperative position of the trigger in the disabled mode of the lighter 21. In such an embodiment, interposing the finger 115 between the plunger 65 and the trigger 35 in the second position of the disabling mechanism 101 corresponding to the normal mode of the lighter 21 would decrease the spacing between the plunger and the trigger, or engage one or both of the plunger and trigger.

In view of the above, it will be seen that the several objects of the invention are achieved and other advantageous results attained. In the disabled mode of the lighter 21 of the present invention, no fuel is released from the fuel container 39 and no electrical charge is generated by the piezoelectric unit 61. As a result, the utility lighter 21 is disabled against generating a flame in the disabled mode of the lighter, even though the trigger 35 may be moved to its depressed, operative position in a manner simulating normal operation of the lighter. This substantially reduces the risk of undesired ignition of combustible materials external of the lighter (e.g., other than the fuel in the fuel container 39). Moreover, small children that inadvertently obtain the lighter 21 and attempt to simulate normal operation of the lighter 21 by squeezing the trigger will not impose additional wear on the piezoelectric unit 61, thereby resulting in an increased useful lifetime of the piezoelectric unit in the lighter.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A utility lighter comprising:

a housing;

a spark generator operable to generate a spark generally adjacent an exit opening of the housing;

a trigger movable relative to the housing between an inoperative position and an operative position, movement of the trigger to its operative position in a normal mode of operation of the lighter operating the spark generator to generate a spark; and a disabling mechanism positionable in a first position corresponding to a disabled mode of operation of the lighter and a second position corresponding to the normal mode of operation of the lighter, said trigger being movable between its inoperative and operative positions in both the disabled mode and the normal mode of the lighter, in the disabled mode of the lighter said disabling mechanism being adapted to disable the trigger from operating the spark generator in the operative position of the trigger, the disabling mechanism comprising a control accessible exterior of the housing and located remote from the trigger for manually positioning the disabling mechanism in at least one of its first and second positions.

2. A utility lighter as set forth in claim 1 wherein the disabling mechanism is positionable relative to the trigger between its first position corresponding to the disabled mode of the lighter and its second position corresponding to the normal mode of the lighter.

3. A utility lighter as set forth in claim 1 wherein the spark generator has an actuating mechanism movable relative to the housing to a discharge position in which the spark generator generates a spark, in the first position of the disabling mechanism corresponding to the disabled mode of the lighter movement of the trigger to its operative position being ineffective to move the actuating mechanism to its discharge position such that no spark is generated by the spark generator in the disabled mode of the lighter, the disabling mechanism being configured such that in its second position corresponding to the normal mode of the lighter the disabling mechanism operatively connects the actuating mechanism of the spark generator and the trigger whereby movement of the trigger to its operative position in the normal mode of the lighter effects movement of the actuating mechanism of the spark generator to its discharge position.

4. A utility lighter as set forth in claim 3 wherein in the first position of the disabling mechanism corresponding to the disabled mode of the lighter the trigger is operatively connected to the actuating mechanism of the spark generator such that movement of the trigger to its operative position effects movement of the actuating mechanism toward its discharge position, the disabling mechanism being configured such that movement of the trigger to its operative position in the disabled mode of the lighter is ineffective to move the actuating mechanism of the spark generator fully to its discharge position so that no spark can be generated by the spark generator in the disabled mode of the lighter.

5. A utility lighter as set forth in claim 3 wherein the disabling mechanism further comprises a finger movable relative to the housing between the first and second positions of the disabling mechanism, in the second position of the disabling mechanism corresponding to the normal mode of the lighter the finger being interposed between the trigger and the actuating mechanism of the spark generator such that movement of the trigger to its operative position effects movement of the actuating mechanism to its discharge position to cause the spark generator to generate a spark, the finger being removed from between the trigger and the actuating mechanism of the spark generator in the first position of the disabling mechanism corresponding to the disabled mode of the lighter such that movement of the trigger to its operative position is ineffective to move the actuating mechanism of the spark generator to its discharge position.

6. A utility lighter as set forth in claim 5 wherein the control is operatively connected to the finger whereby positioning of the control effects positioning of the finger relative to the trigger and the actuating mechanism of the spark generator.

7. A utility lighter as set forth in claim 5 wherein the disabling mechanism further comprises an actuator movable relative to the trigger in a direction other than the direction of travel of the trigger between the inoperative and operative positions of the trigger, the actuator being operatively connected to the control and the finger being operatively connected to the actuator whereby positioning the control in the second position of the disabling mechanism corresponding to the normal mode of the lighter effects movement of the actuator relative to the trigger to interpose the finger between the trigger and the actuating mechanism of the spark generator.

8. A utility lighter as set forth in claim 7 further comprising a fuel container generally disposed in the housing for containing a combustible fuel, and a sealing valve in fluid communication with the fuel container and movable between a closed, sealing position in which the fuel container is sealed against fuel release and an open position in which fuel is released from the fuel container for delivery toward the exit opening of the housing, movement of the trigger to its operative position in the normal mode of the lighter effecting movement of the sealing valve to its open position and operating the spark generator to generate a spark to thereby generate a flame at the exit opening of the housing.

9. A utility lighter as set forth in claim 8 wherein in the disabled mode of the lighter, movement of the trigger to its operative position is ineffective to move the sealing valve toward its open position.

10. A utility lighter as set forth in claim 1 wherein the disabling mechanism further comprises a biasing member biasing the disabling mechanism toward its first position corresponding to the disabled mode of the lighter.

11. A utility lighter as set forth in claim 1 further comprising:

a fuel container generally disposed in the housing for containing a combustible fuel, and a sealing valve in fluid communication with the fuel container and movable between a closed, sealing position in which the fuel container is sealed against fuel release and an open position in which fuel is released from the fuel container for delivery toward the exit opening of the housing, movement of the trigger to its operative position in the normal mode of the lighter effecting movement of the sealing valve to its open position and operating the spark generator to generate a spark to thereby generate a flame at the exit opening of the housing.

12. A utility lighter as set forth in claim 11 wherein in the disabled mode of the lighter, movement of the trigger to its operative position is ineffective to move the sealing valve toward its open position.

13. A utility lighter as set forth in claim 1 wherein the disabling mechanism is biased toward its first position corresponding to the disabled mode of the lighter, the trigger is biased toward its inoperative position and the sealing valve is biased toward its closed position.

14. A utility lighter as set forth in claim 13 wherein the trigger is biased toward its inoperative position by the spark generator.

15. A utility lighter as set forth in claim 1 wherein the spark generator is a piezoelectric unit.

16. A utility lighter as set forth in claim 1 wherein the control is moveable in a direction other than the direction of travel of the trigger between the inoperative and operative positions of the trigger.

17. A utility lighter as set forth in claim 16 wherein the control is inhibited against movement relative to the housing in the direction of travel of the trigger.

18. A utility lighter comprising:

a housing;

a fuel container generally disposed in the housing for containing a combustible fuel;

a sealing valve in fluid communication with the fuel container and movable between a closed, sealing position in which the fuel container is sealed against fuel release and an open position in which fuel is released from the fuel container for delivery toward the exit opening of the housing;

a valve lever movable relative to the housing and being operatively connected to the sealing valve whereby movement of the lever effects movement of the sealing valve between its closed and open positions;

a spark generator operable to generate a spark generally adjacent an exit opening of the housing, the spark generator having an actuating mechanism movable relative to the housing to a discharge position in which the spark generator generates a spark;

a trigger movable relative to the housing between an inoperative position and an operative position, movement of the trigger to its operative position in a normal mode of operation of the lighter effecting movement of the valve lever to move the sealing valve to its open position and operating the spark generator to generate a spark to thereby ignite the fuel to generate a flame at the exit opening of the housing; and a disabling mechanism positionable in a first position corresponding to a disabled mode of operation of the lighter and a second position corresponding to the normal mode of operation of the lighter, said trigger being movable between its inoperative and operative positions in both the disabled mode and the normal mode of the lighter, in the disabled mode of the lighter said disabling mechanism being adapted to disable the trigger from operating the spark generator in the operative position of the trigger, the disabling mechanism comprising a control accessible exterior of the housing and located remote from the trigger for manually positioning the disabling mechanism in at least one of its first and second positions.

19. A utility lighter as set forth in claim 18 wherein in the disabled mode of the lighter, movement of the trigger to its operative position is ineffective to move the sealing valve toward its open position.

20. A utility lighter comprising:

a housing;

a spark generator operable to generate a spark generally adjacent an exit opening of the housing;

a trigger movable relative to the housing between an inoperative position and an operative position, movement of the trigger to its operative position in a normal mode of operation of the lighter operating the spark generator to generate a spark; and a disabling mechanism positionable in a first position corresponding to a disabled mode of operation of the lighter and a second position corresponding to the normal mode of operation of the lighter, said trigger being movable between its inoperative and operative positions in both the disabled mode and the normal mode of the lighter, in the disabled mode of the lighter said disabling mechanism being adapted to disable the trigger from operating the spark generator in the operative position of the trigger, the disabling mechanism comprising a finger movable relative to the housing between the first and second positions of the disabling mechanism, in the second position of the disabling mechanism corresponding to the normal mode of the lighter the finger being interposed between the trigger and the actuating mechanism of the spark generator such that movement of the trigger to its operative position effects movement of the actuating mechanism to its discharge position to cause the spark generator to generate a spark, the finger being removed from between the trigger and the actuating mechanism of the spark generator in the first position of the disabling mechanism corresponding to the disabled mode of the lighter such that movement of the trigger to its operative position is ineffective to move the actuating mechanism of the spark generator to its discharge position, said finger having a generally tapered contact surface for engaging at least one of the trigger and the actuating mechanism of the spark generator to facilitate interposition of the finger therebetween upon positioning of the disabling mechanism in its second position corresponding to the normal mode of the lighter.

21. A utility lighter comprising:

a housing;

a fuel container generally disposed in the housing for containing a combustible fuel;

a spark generator operable to generate a spark generally adjacent an exit opening of the housing;

a trigger movable relative to the housing between an inoperative position and an operative position, movement of the trigger to its operative position in a normal mode of operation of the lighter operating the spark generator to generate a spark;

a disabling mechanism positionable in a first position corresponding to a disabled mode of operation of the lighter and a second position corresponding to the normal mode of operation of the lighter, said trigger being movable between its inoperative and operative positions in both the disabled mode and the normal mode of the lighter, in the disabled mode of the lighter said disabling mechanism being adapted to disable the trigger from operating the spark generator in the operative position of the trigger, the disabling mechanism further comprising an actuator movable relative to the trigger;

a sealing valve in fluid communication with the fuel container and movable between a closed, sealing position in which the fuel container is sealed against fuel release and an open position in which fuel is released from the fuel container for delivery toward the exit opening of the housing, movement of the trigger to its operative position in the normal mode of the lighter effecting movement of the sealing valve to its open position and operating the spark generator to generate a spark to thereby generate a flame at the exit opening of the housing; and a valve lever movable relative to the housing and being operatively connected to the sealing valve whereby movement of the lever effects movement of the sealing valve between its closed and open positions, the actuator of the disabling mechanism being movable relative to the trigger in a direction other than the direction of travel of the trigger between its operative and inoperative positions, the actuator being connected to the trigger for conjoint movement therewith in the direction of travel of the trigger between its operative and inoperative positions, the actuator comprising an actuating member for engaging the valve lever as the trigger is moved to its operative position in the second position of the disabling mechanism corresponding to the normal mode of the lighter to move the valve lever thereby to move the sealing valve to its open position, in the first position of the disabling mechanism corresponding to the disabled mode of the lighter the actuating member being ineffective to move the valve lever to position the sealing valve in its open position in the operative position of the trigger.

* * * * *